United States Patent [19]

Nagler et al.

[11] 4,120,129

[45] Oct. 17, 1978

[54] PIPE FLASHING UNIT

[75] Inventors: William M. Nagler, Chicago, Ill.; Vernon Earl Woosley, Richmond, Va.

[73] Assignee: The Pate Company, Broadview, Ill.

[21] Appl. No.: 719,422

[22] Filed: Sep. 1, 1976

[51] Int. Cl.[2] ..... E04D 13/14; E04G 15/06

[52] U.S. Cl. ..... 52/219; 52/58; 285/4; 285/44

[58] Field of Search ..... 52/219, 58, 295, 296; 285/42, 43, 3, 4, 44, 137 R, 236

[56] References Cited

U.S. PATENT DOCUMENTS

| | | | |
|---|---|---|---|
| 1,258,884 | 3/1918 | Fife | 285/4 |
| 2,510,926 | 6/1950 | Goldstein | 285/43 |
| 3,313,559 | 4/1967 | Kifer | 285/43 |
| 3,602,530 | 8/1971 | Elwart | 285/4 |
| 3,677,576 | 7/1972 | Gustafson | 285/43 |
| 3,731,952 | 5/1973 | Elwart | 285/3 |
| 3,797,181 | 3/1974 | Nievelt | 285/43 X |
| 3,807,110 | 4/1974 | Kaminski | 52/219 |
| 3,866,950 | 2/1975 | Skoch et al. | 285/4 |

FOREIGN PATENT DOCUMENTS

| | | | |
|---|---|---|---|
| 98,900 | 1/1922 | Switzerland | 285/43 |

*Primary Examiner*—Alfred C. Perham
*Assistant Examiner*—Robert C. Farber
*Attorney, Agent, or Firm*—Alter and Weiss

[57] ABSTRACT

A roof mountable pipe flashing unit allows penetration of the roof surface by a single pipe while effectively weather-proofing the site of penetration. A selectively separable sealing element enables a weathertight seal to be formed with pipes whose diameters fall within a selected range.

4 Claims, 4 Drawing Figures

PIPE FLASHING UNIT

This invention relates generally to flashing units for roofs, and, more particularly, to a flashing unit for a single cylindrical element such as a pipe penetrating a built-up roof surface (hereinafter referred to simply as "roof surfaces").

Passage of cylindrical elements such as pipe members through roof surfaces is frequently required during construction of buildings as, for example, when air conditioning or electrical lines must be passed through a roof surface from the interior of a building to roof mounted heating, cooling, or ventilation equipment. Any penetration of a roof surface carries with it the risk that the site of penetration may develop a leak thereby exposing the interior of the building to serious weather damage. Thus, various means have been sought to successfully interrupt the normally water and weather proof materials applied to a roof surface to enable passage therethrough of pipe members in a manner to maintain the weather-tight integrity of the roof surface. The problem is exacerbated by architectural and structural plans requiring many such penetrations at sites not easily precisely determinable prior to construction. Pipe penetration structures such as that illustrated in U.S. Pat. No. 3,807,110 provide highly effective and successful means for passing pipes through roofs. Such structures, however, require careful preplanning as to location during construction; such devices may also be prohibitively expensive in terms of labor and materials when a great number of single pipe penetrations must be accomplished. A standard roofing approach heretofore followed has been to use pitch or tar to form a seal about the pipe at the site of penetration. Such seals are, however, temporary at best, since exposure to sun and to weather will eventually cause expansion and cracking of such seals, thereby resulting in leaks. Any structure utilizing a number of such "pitch pocket" seals will require substantial maintenance after installation since such seals must be periodically repaired or replaced.

Other devices, such as those illustrated in U.S. Pat. Nos. 3,313,559; 3,602,530; 3,708,185; 3,731,952 and 3,871,145, offer attempted solutions to the problem of weather-proofing a single pipe penetration. Such devices, however, are limited in application to pipes of a specified diameter and a different size of flashing element must be provided for each different pipe size. Others may provide for pipes of at most two different sizes, but none provides an installation adaptable for pipes of as many as eight or nine different sizes. Another problem posed by such installations is their permanence. Once such a device is installed, it is very difficult to disassemble in the event that repair or replacement must be carried out involving the penetrating pipe. An additional problem may arise if the pipe to be removed is replaced by a pipe different in size.

Another problem faced during construction occurs when openings for pipe members must be roofed in long prior to actual installation of the pipes themselves. This may occur when roof mounted machinery or gas, chemical, water or electrical lines intended to penetrate a roof surface are, in fact, not installed until after construction on the roof portion of the building is complete. Devices heretofore used for single pipe penetration including those mentioned above provide no weatherproofing unless a pipe segment is actually present at the penetration site. Thus, such devices can be completely roofed in only at the time penetration is made, rather than in accordance with a previously determined construction schedule.

Penetration of an already existing roof also presents problems which must be solved by such single pipe penetration devices. Such devices must be adapted to be "roofed in" on an existing structure. Interruption of the weather proof integrity of the roof is required in such a situation; any single pipe penetrating device used should enable such integrity to be restored.

Accordingly, this invention has the following objects:

- to provide flashing units for single pipes adapted for installation on existing roof surfaces as well as during construction of new roof surfaces;
- to provide such units in forms economical to use for single pipe penetrations;
- to provide such units in forms adaptable to accommodate pipes of widely varying diameters;
- to provide such units in forms adaptable to weather tightly seal a roof penetration pending installation of the required pipe member; and
- to provide such units having unitarily formed components to minimize the hazard of leakage,
- to provide a flexible weather proof connection which easily withstands expansion, contraction, vibration, or any other movements of the cylindrical penetrating element.

The foregoing objects will best be understood by reference to the accompanying drawings, in which.

Figure 1:
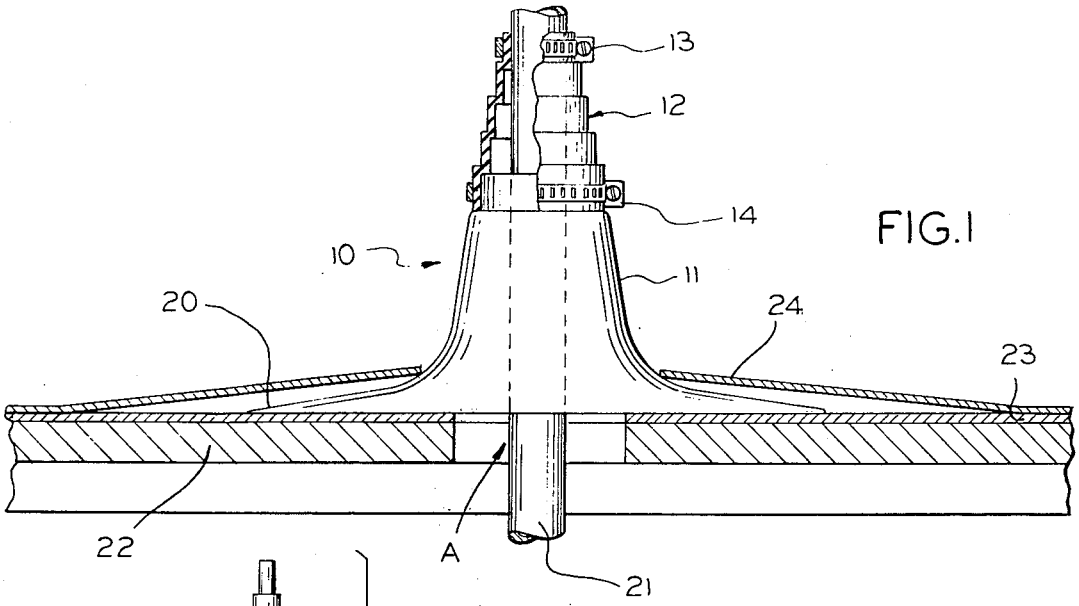
FIG. 1 is a front elevation of the pipe seal as installed on a roof.
Figure 2:
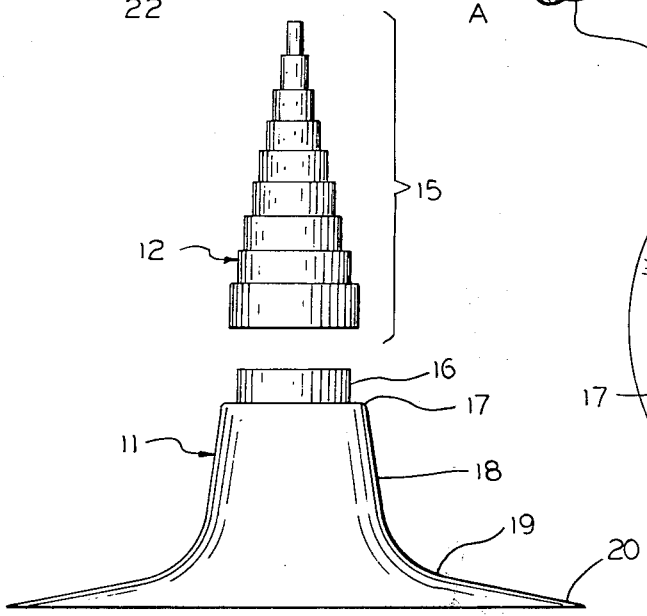
FIG. 2 is an exploded view of the device illustrated in FIG. 1 prior to assembly.

Referring now to FIG. 1, the numeral 10 indicates generally a pipe flashing assembly having housing 11, boot 12 and clamps 13 and 14. As illustrated in FIG. 2, boot 12 is formed with stepped portions 15, each such section being progressively larger in diameter as viewed from top to bottom to form a roughly pyramid-shaped sealing element. The range of diameters selected for stepped portions 15 corresponds to the outside diameters of popularly used sizes of piping. Sealing element 12 is integrally fashioned in this embodiment from a flexible, somewhat deformable material such as neoprene.

Figure 3:
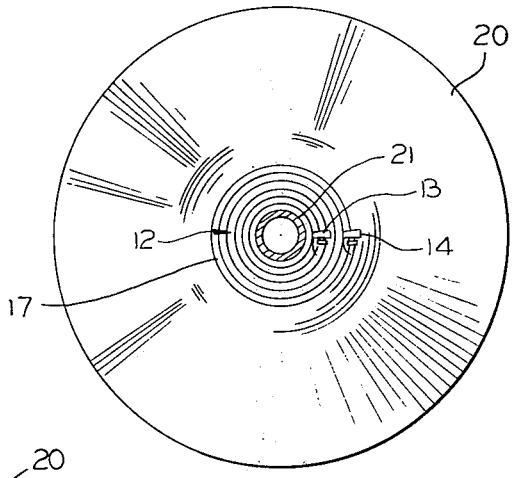
FIG. 3 is a top view of the device illustrated in FIG. 1.
Figure 4:
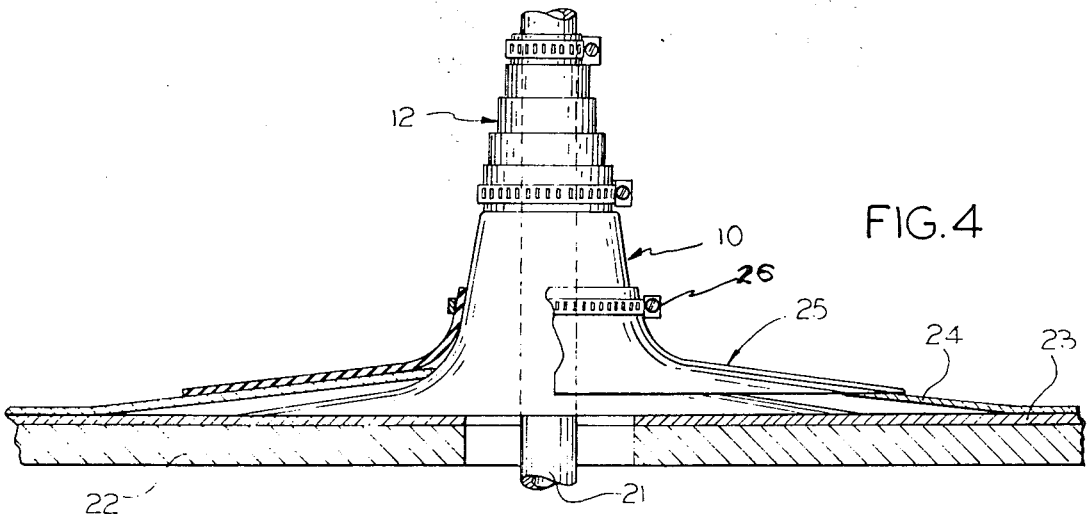
FIG. 4 is an exploded side view of another embodiment of the pipe seal of FIG. 1.

Housing or flashing body 11 is preferably fashioned as a single seamless integral unit. In this embodiment, housing 11 is "spun" from a single piece of aluminum and has a first vertical section 16, a flaring shoulder 17, a vertically extending outwardly tapered portion 18, and a base portion 19, terminating in a flange 20. As illustrated in FIG. 3, this embodiment of the inventive seal is generally cyclindrical having a round base flange 20 and a cyclindrical portion tapering upward to shoulder 17. Thus, flashing body 11 takes on a somewhat "Pilgrim's hat" shape.

Use of more conventional roof penetration systems generally requires a hole through the roof surface substantially larger than the pipes which must pass therethrough. This is occasioned by the necessity of exposing a portion of the roof in order to anchor or "roof in" a more conventional roof curb structure. Installation of such roof curb structures is typically done during roof construction and, since the holes required for such curb structures are large, it is critical that the curb structure be positioned precisely at the point at which the pipes will pass through the roof surface. Heretofore, this has been expensive, yet satisfactory when a number of pipes must pass through the roof at approximately the same point; the roof curb in that instance defines a chase large enough to accommodate all such pipes. However, in the case of a single pipe penetration, use of roof curbs is prohibitive in cost, especially since the hole formed through the roof surface need be no larger than the outside diameter of the pipe.

Use of pipe flashing unit 10 and the advantages obtained therefrom are best illustrated by considering a typical installation. If during construction it is found necessary to pass a single pipe member 21 through roof 22 at site A as illustrated in FIG. 1, a hole is formed at site A to the approximate size of the outside diameter of pipe member 21. Flashing body 11 is next positioned at the hole site with base flange 20 contacting roof membrane 23. Overlapping layers of membrane 24 may then be stripped or "lapped" to cover base flange 20 and may be sealed in place by mastic, hot pitch, or any other roof sealing material. It should be noted that the slope of base 19 will direct moisture away from the pipe opening and that lapping membrane 24 to flange 20 provides in essence a double flashing to prevent moisture from reaching the pipe penetration site.

Boot 12 is then clamped to flashing base 11 at upstanding portion 16 which is dimensioned to closely fit the lowermost portion of boot 12. In this manner, the water-tight integrity of the roof is maintained until construction proceeds to the point where penetration of roof 22 by pipe 21 is required. At that point, boot 12 is severed at that section 15 most closely corresponding to the outside diameter of pipe 21. After pipe 21 has been passed therethrough, boot 12 is clamped to pipe 21 to complete a water-tight seal. Should repair or removal of pipe 21 be required at any later date, clamp 13 may be loosened allowing removal of pipe 21 and reinsertion of a new pipe member. If the new pipe member has a diameter substantially different than that of pipe 21, a new boot may be furnished and severed to match the new diameter, or the existing boot may be severed or stretched to fit a pipe of larger diameter.

Thus, the single pipe penetration of roof 22 is protected by a flashing structure which directs moisture away from the roof opening required by pipe 21 while still affording protection until installation of pipe 21 is required and allowing removal and reinstallation of pipe 21 if necessary.

Pipe flashing unit 10 may also be utilized to effect a single pipe penetration through an already existing and constructed roof without requiring significant disruption of the roof surface integrity. The roof membrane 23 is penetrated to accept the pipe size. Mastic (or like material) is applied to the roof membrane and the pipe flashing 10 is placed in the mastic and counter-flashed using standard roofing procedure. In some instances, a separate elastomeric counter-flashing shield 25 may be fastened about the periphery of pipe flashing unit 10 to provide additional moisture protection. Said shield may provide an additional slope to direct moisture away from the pipe penetration site, and is secured by clamp 26.

While the description of the foregoing embodiment features a housing 11 spun from aluminum sheet material, it is contemplated that housing 11 may be formed by any process and from any material which would result in a unitary structure of sufficient durability, strength and resistance to extremes of temperature to satisfactorily weatherproof a roof penetration site.

In a second contemplated embodiment of the pilpe flashing unit, housing 11 and boot 12 are unitarily, integrally formed as a single piece, preferably by molding. In this manner, no additional clamping element, such as 14, would be required to secure boot 12 to housing 11. As described hereinabove, the boot portion 12 of such a second embodiment, would be selectively severable to accept pipes of varying outside dimension, while housing portion 11 would be roofed in to surround a roof penetration site using standard roofing techniques.

Thus, pipe flashing unit 10 provides a weatherproof chase, and an efficient, easy way to install pipe flashing units, utilizing standard roofing compounds to effect a watertight seal, yet obviating the age-old maintenance and leakage problems that have beset roofers through use of such materials. Installation of pipe flashing unit 10 provides several counter flashing structures whose watertight integrity is not affected by the tendency of large quanities of pitch or other roofing material to expand, contract and crack during weathering.

While the foregoing has presented a specific embodiment of the invention, it is to be understood that this embodiment is presented by way of example only. It is expected that others skilled in the art will perceive variations which, while differing from the foregoing, do not depart from the spirit and scope of the invention.

I claim:

1. A flashing unit to provide weather proof egress for a single pipe element through a roof surface, said flashing unit comprising:

a unitary hollow housing of seamless construction, having an axis perpendicular to said surface, said housing being circular in cross-section perpendicular to said axis, said housing having an upper end and a lower end, said upper end and said lower end being open, thereby defining a passageway through said housing;

a circular base flange, said flange formed integrally with said housing at said lower end, said flange being formed perpendicular to said axis to contact a flat surface, said housing tapering generally outwardly from said upper end to said flange; and a hollow sealing element having a top and a bottom, said sealing element including a plurality of concentric upstanding stepped sections of differing cross-sectional dimension, said stepped sections being arranged in order of increasing cross-sectional dimension from said top to said bottom, said stepped sections being selectively severable whereby a communicating passageway through said sealing element may be formed, said bottom of said sealing element sized to closely fit said housing at said upper end of said housing, whereby said housing, said pipe element, and said sealing element define a chase, sealed at its top, for said pipe element; and means for retaining said sealing element in weather tight contact with said housing and with said pipe element.

2. The apparatus as recited in claim 1 wherein said flashing further includes means for counterflashing, said counterflashing means being sized and adapted to contact said housing at a predetermined site about the surface of said housing, said counterflashing means extending above and overlapping said flange.

3. The apparatus as recited in claim 1 wherein said housing is integrally spun from a single sheet of metal.

4. The apparatus as recited in claim 2 wherein said counterflashing means is a circumferential, depending skirt, said skirt removably positioned at said point on said housing.

* * * * *

UNITED STATES PATENT AND TRADEMARK OFFICE

CERTIFICATE OF CORRECTION

PATENT NO. : 4,120,129

DATED : October 17, 1978

INVENTOR(S) : William M. Nagler & Vernon E. Woosley

It is certified that error appears in the above-identified patent and that said Letters Patent are hereby corrected as shown below:

| | |
|---|---|
| Col. 4, Line 4 | Change "pilpe" to --pipe--. |
| Col. 4, Line 51 | Change "concentric" to --coencentric--. |

Signed and Sealed this

Sixth Day of March 1979

[SEAL]

*Attest:*

RUTH C. MASON
*Attesting Officer*

DONALD W. BANNER
*Commissioner of Patents and Trademarks*